US005154257A

United States Patent [19]

Mirles

[11] Patent Number: 5,154,257

[45] Date of Patent: Oct. 13, 1992

[54] ADJUSTABLE LADDER APPARATUS

[76] Inventor: Virgil S. Mirles, 634 Calle Manuel Ramon B. Lomas, Mayaguez, P.R. 00708

[21] Appl. No.: 756,515

[22] Filed: Sep. 9, 1991

[51] Int. Cl.[5] ..... E06C 7/44

[52] U.S. Cl. ..... 182/201; 248/188.5

[58] Field of Search ..... 182/204, 203, 201, 107, 182/108, 111, 200, 205; 248/188.4, 188.5

[56] References Cited

U.S. PATENT DOCUMENTS

| | | | |
|---|---|---|---|
| 409,711 | 8/1889 | Sickles | 182/204 |
| 2,581,782 | 1/1952 | Anderson | 182/204 |
| 3,791,487 | 2/1974 | Baumann | 182/201 |
| 4,423,797 | 1/1984 | Batten | 182/204 |
| 4,671,383 | 6/1987 | Huang | 182/204 |
| 4,744,441 | 5/1988 | Sandstrom | 182/201 |

*Primary Examiner*—Reinaldo P. Machado
*Attorney, Agent, or Firm*—Leon Gilden

[57] ABSTRACT

A ladder apparatus including a plurality of spaced parallel ladder legs, with each ladder leg telescopingly mounting an extension leg relative to each ladder leg to accommodate uneven surface conditions. Interlocking structure is provided to secure each respective extension leg relative to a receiving cylinder relative to each ladder leg.

3 Claims, 7 Drawing Sheets

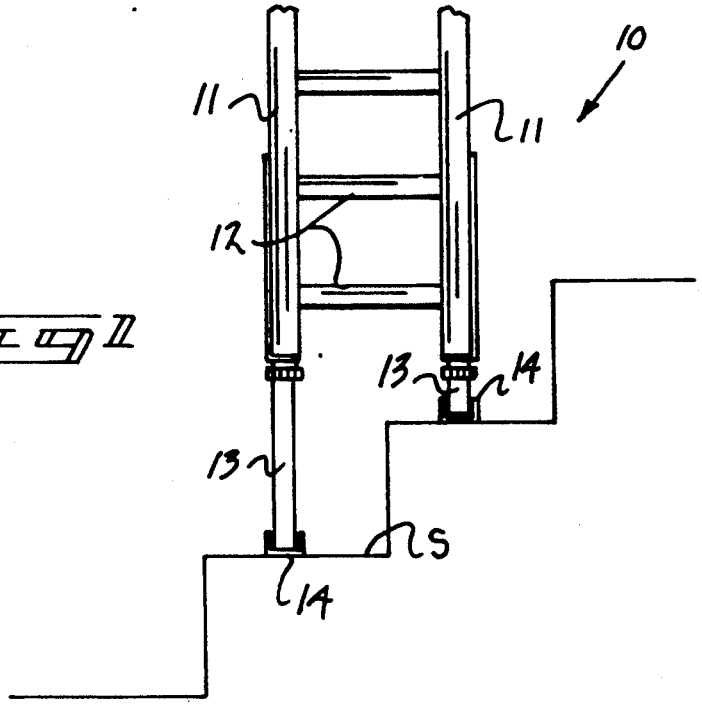
Fig 1
Fig 2
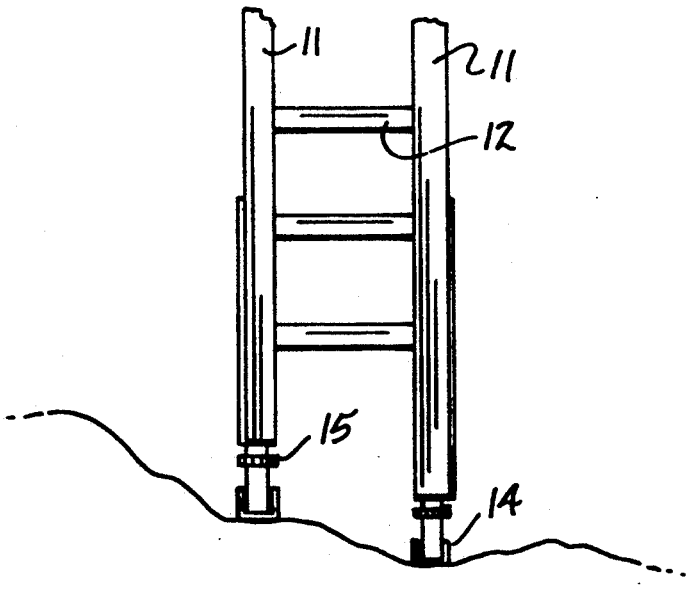

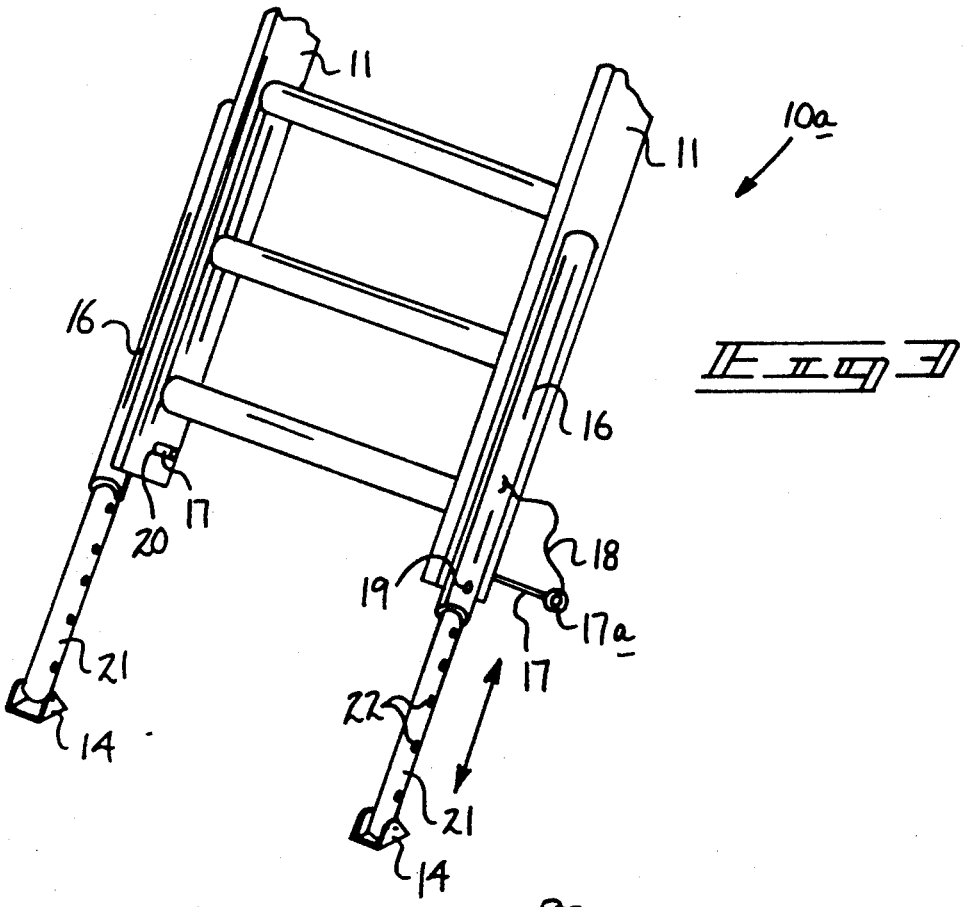
Fig 3
Fig 4
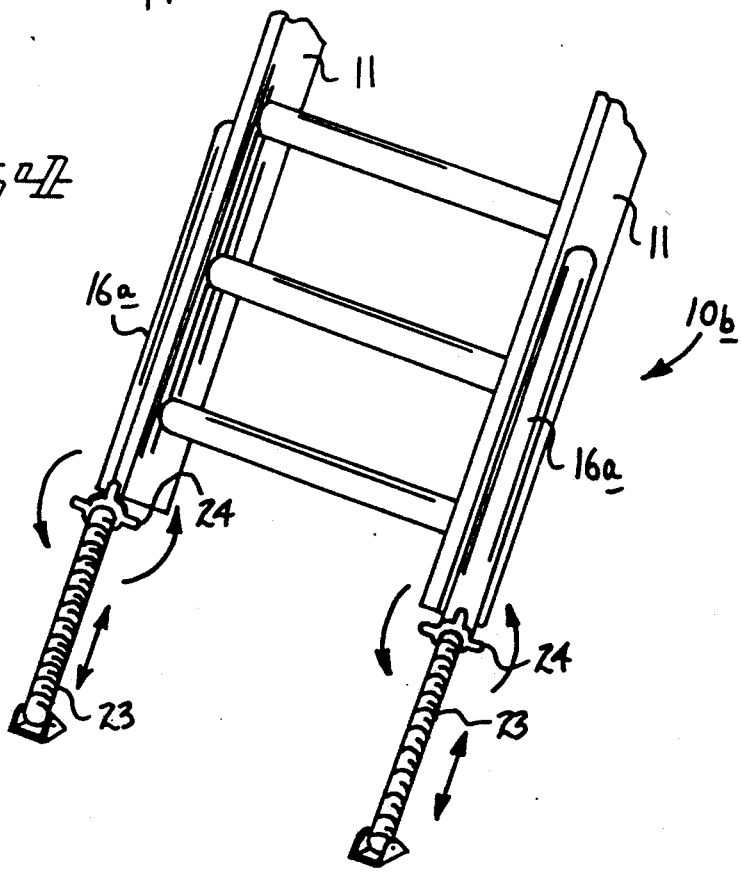

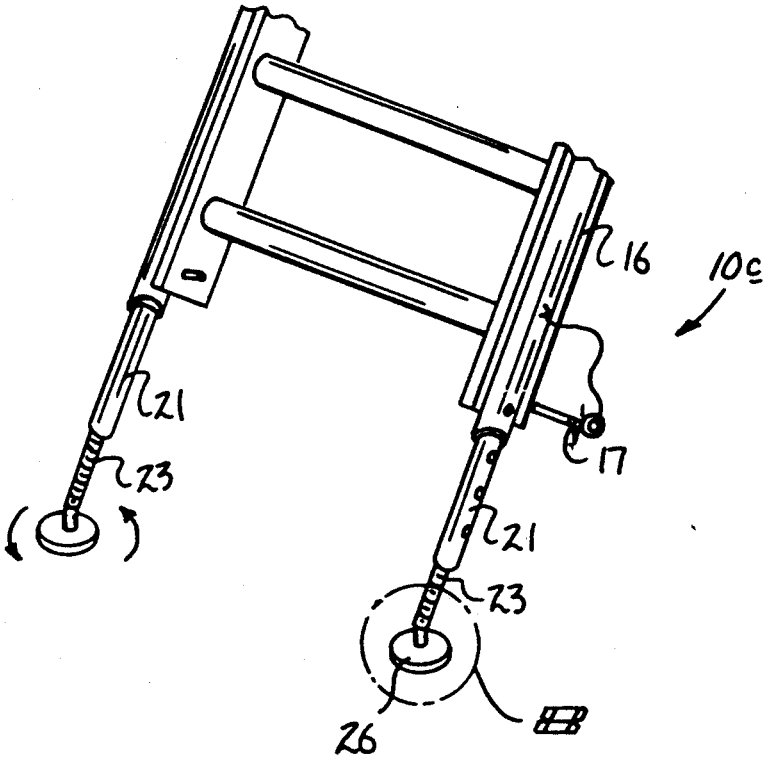
Fig 5
Fig 8
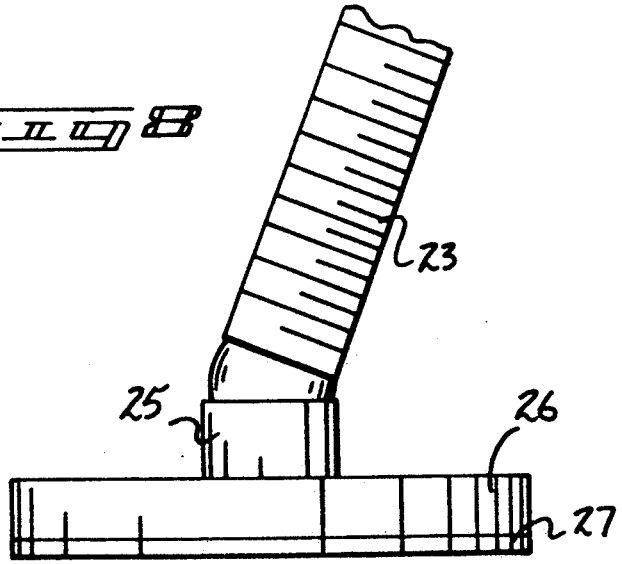

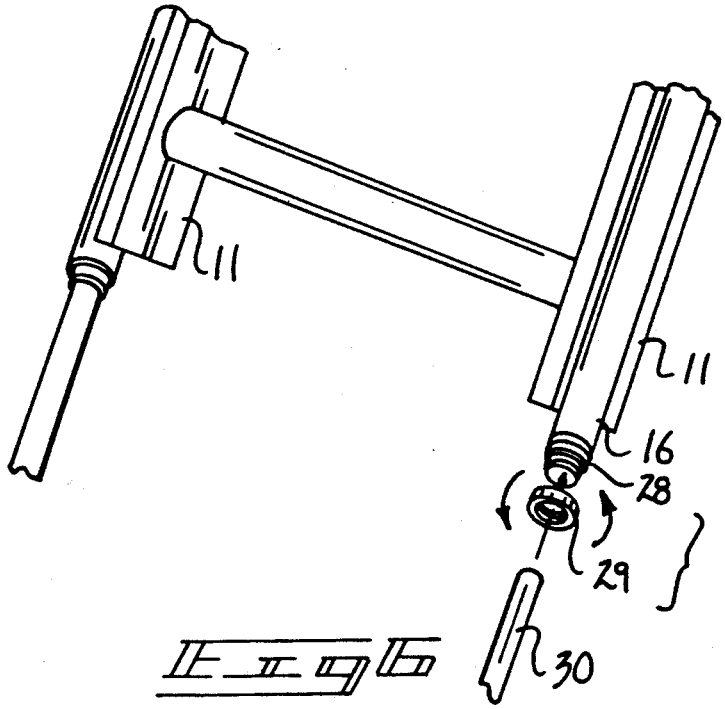
Fig 6
Fig 7
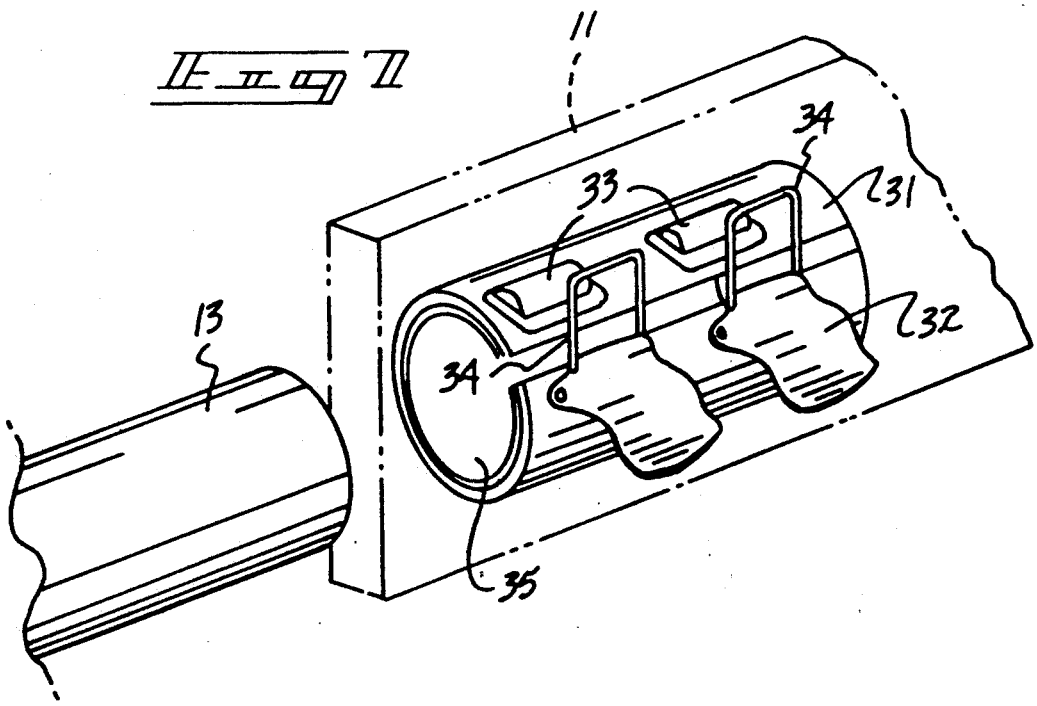

ADJUSTABLE LADDER APPARATUS

BACKGROUND OF THE INVENTION

1. Field of the Invention

The field of invention relates to ladder apparatus, and more particularly pertains to a new and improved adjustable ladder apparatus wherein the same is arranged for providing selective extension of each ladder leg to accommodate uneven underlying support surfaces.

2. Description of the Prior Art

Positioning a ladder relative to a supporting structure upon an underlying surface is a typical utilization of a ladder apparatus. Frequently, however, when a ladder is not mounted upon a level surface, accident and inadvertent associated tippage of the ladder is available. Such situations effect a dangerous condition wherein associated loss of time and individual health is effected. Ladder structure is available in the prior art to provide for relative telescoping leg structure, but have heretofore been of structure to provide such relative relationship in the prior art. Such structure is exemplified in U.S. Pat. No. 4,423,797 to Batten wherein sleeves mounted to side walls of spaced parallel ladder legs are mounted relative thereto.

U.S. Pat. No. 4,090,486 to Pears sets forth a ladder stabilizing apparatus wherein a sleeve mounted to an exterior wall of each ladder leg threadedly mounts an extension leg.

U.S. Pat. No. 4,792,017 to Grove sets forth a ladder leg extension structure utilizing locking nut means mounted thereto.

U.S. Pat. No. 4,852,689 to Erion provides for a ladder leveling apparatus utilizing aligned apertures permitting selective telescoping of an extension leg relative to each ladder leg.

As such, it may be appreciated that there continues to be a need for a new and improved adjustable ladder apparatus as set forth by the instant invention which addresses both the problems of ease of use as well as effectiveness in compactness of construction and in this respect, the present invention substantially fulfills this need.

SUMMARY OF THE INVENTION

In view of the foregoing disadvantages inherent in the known types of ladder apparatus now present in the prior art, the present invention provides an adjustable ladder apparatus wherein the same utilizes extensible legs relative to each ladder leg to accommodate uneven support surfaces mounting the ladder structure of the invention. As such, the general purpose of the present invention, which will be described subsequently in greater detail, is to provide a new and improved adjustable ladder apparatus which has all the advantages of the prior art ladder apparatus and none of the disadvantages.

To attain this, the present invention provides a ladder apparatus including a plurality of spaced parallel ladder legs, with each ladder leg telescopingly mounting an extension leg relative to each ladder leg to accommodate uneven surface conditions. Interlocking structure is provided to secure each respective extension leg relative to a receiving cylinder relative to each ladder leg.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable ladder apparatus which has all the advantages of the prior art ladder apparatus and none of the disadvantages.

It is another object of the present invention to provide all new and improved adjustable ladder apparatus which may be easily and efficiently manufactured and marketed.

It is a further object of the present invention to provide a new and improved adjustable ladder apparatus which is of a durable and reliable construction.

An even further object of the present invention is to provide a new and improved adjustable ladder apparatus which is susceptible of a low cost of manufacture with regard to both materials and labor, and which accordingly is then susceptible of low prices of sale to the consuming public, thereby making such adjustable ladder apparatus economically available to the buying public.

Still yet another object of the present invention is to provide a new and improved adjustable ladder apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view, taken in elevation, of a typical ladder extension construction of the instant invention.

FIG. 2 is the invention relative to an underlying undulating support surface.

FIG. 3 is an isometric illustration of a modification of the invention.

FIG. 4 is an isometric illustration of a further modification of the invention.

FIG. 5 is an isometric illustration of a further modification of the instant invention.

FIG. 6 is an isometric illustration of a further clamp structure utilized by the instant invention.

FIG. 7 is an isometric illustration of a yet further clamp structure utilized by the instant invention.

FIG. 8 is an orthographic view, somewhat enlarged, of section 8 as set forth in FIG. 5.

FIG. 10 is an isometric illustration of the sleeve structure as set forth in FIG. 9 arranged in a planar configuration.

DESCRIPTION OF THE PREFERRED EMBODIMENT

Figure 11:
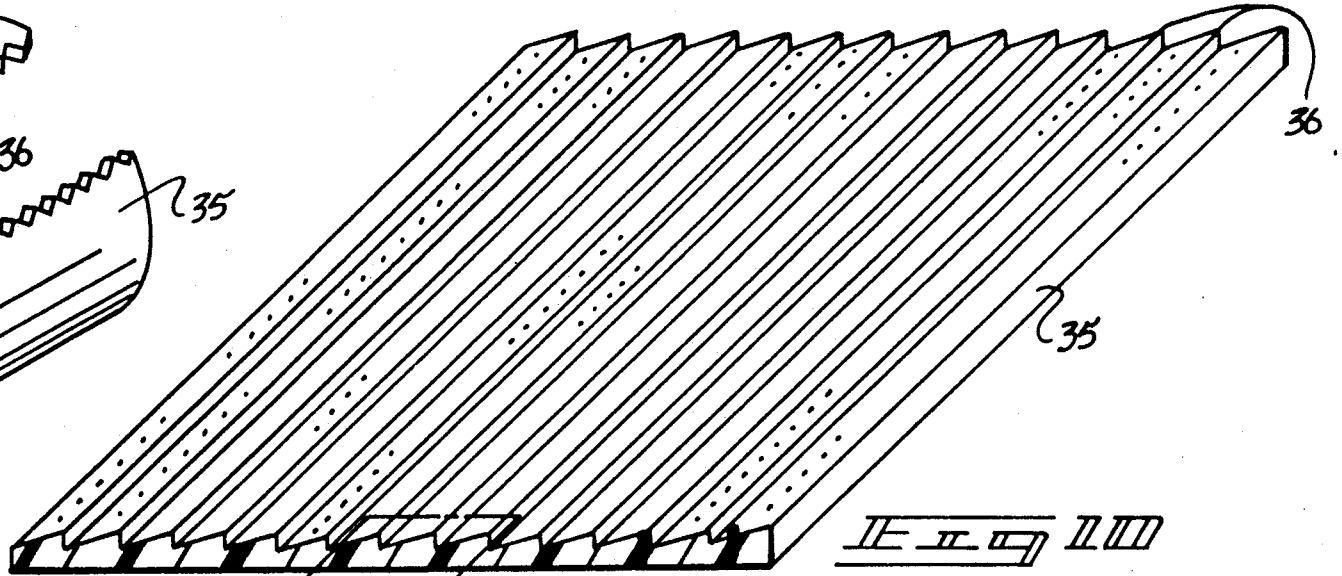
FIG. 11 is an orthographic view, taken along the lines 11—11 of FIG. 10 in the direction indicated by the arrows.
Figure 11:
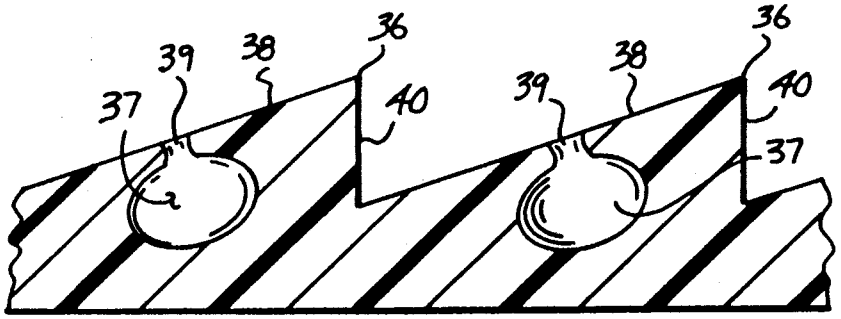
Figure 9:
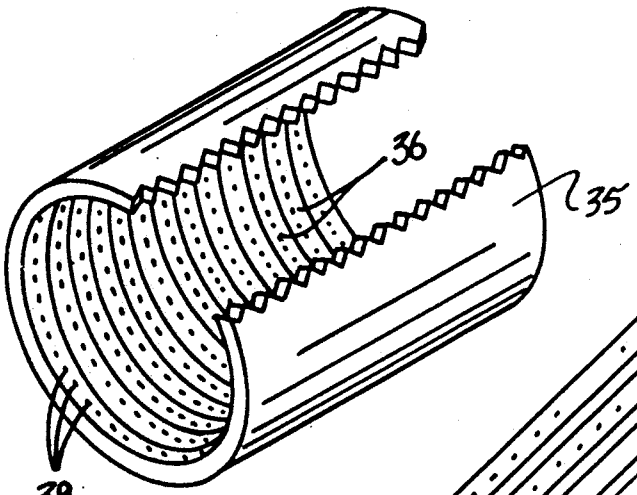
FIG. 9 is an isometric illustration of sleeve structure utilized by the clamp construction of FIG. 7.

With reference now to the drawings, and in particular to FIGS. 1 to 16 thereof, a new and improved adjustable ladder apparatus embodying the principles and concepts of the present invention and generally designated by the reference numeral 10 will be described.

More specifically, the adjustable ladder apparatus 10 of the instant invention essentially includes in the construction as set forth in FIG. 1 for example, a plurality of parallel ladder legs 11 that are directed coextensively relative to one another and include spaced ladder rungs 12 directed orthogonally between the ladder legs. Each of the ladder legs 11 includes a ladder leg extension 13 reciprocatably mounted within each ladder leg, with a support foot 14 pivotally mounted at each lower terminal end of each ladder leg extension.

The construction of FIG. 3 illustrates the use of a tube member 16 mounted exteriorly and in a parallel spaced longitudinally aligned relationship relative to each ladder leg 11 to include a lock pin 17, with a lock pin eye 17*a* mounting a tether line 18 to the lock pin eye and to a respective tube member 16. A first plurality of apertures 19 are directed through the tube 16 adjacent a lower terminal end thereof aligned with a second aperture 20 through the respective ladder leg 16. Telescoping extension leg 21 is reciprocatably mounted within the respective tube members 16 to include a plurality of extension leg apertures 22 spaced apart at equal spacings and diametrically directed through the extension leg 21 to receive the lock pin 17 through the first apertures 19, the extension leg apertures 22, and the associated second aperture 20 simultaneously to maintain each extension leg in an extended relationship.

The organization 10*b*, as set forth in FIG. 4, includes a modified tube member 16*a* that is internally threaded to threadedly receive in an adjustable manner an associated externally threaded extension leg 23. An internally threaded lock collar 24 threadedly mounted about each respective extension leg 23 when threaded into abutment with a lower terminal end of the associated modified tube member 16*a* effects positioning in a fixed manner of an extension leg relative to an associated tube member 16*a*.

The construction of FIG. 5 set forth as the apparatus 10*c* utilizes the externally threaded extension leg 23 threadedly received within the telescoping extension leg 21 that is adjustably securable to the modified tube member 16, in a manner as described in reference to FIG. 3 and the apparatus 10*a*. The lower terminal end of the externally threaded leg 23 in the construction of FIG. 5 utilizes a support plate 26, including a ball and socket interconnection 25 between the lower terminal end of the leg 23 and the plate 26 that may also include a friction plate surface 27 formed of a polymeric type material to enhance frictional engagement with an underlying surface.

The construction of FIG. 6 utilizes an externally threaded conical lower tube end 28 mounted to the tube 16, wherein the tube end 28 includes an internally threaded cap 29 defining a collet structure to effect inter-engagement and locking of the extension leg 30 relative to the tube member 16.

The construction of FIG. 7 is a yet further modified locking arrangement of an extension leg relative to a ladder leg 11, wherein the extension leg 13 is reciprocatably mounted within an associated spring-biased split cylindrical lock sleeve 31 whose cylindrical wall is split to define a gap parallel to an axis defined by the associated lock sleeve 31. A plurality of clamps 32 are provided, wherein each clamp includes a clamp loop 34 on a first side of the gap to cooperative with a respective clamp boss 33 on an opposed side of the gap to effect locking of an extension leg 13 received within the associated sleeve 31. It should be understood that each ladder leg 11 utilizes a like construction, wherein for purposes of illustration only one such construction is illustrated. A resilient liner 35 is coextensively formed with an interior surface of the lock sleeve 31 and is formed by a series of equally spaced parallel friction ribs 36. The friction ribs 36 each include an inclined ribbed top surface 38 defining an acute angle, with a planar rib wall 40. The planar rib wall 40 of each of the ribs 36 are arranged in a parallel relationship relative to one another, wherein the planar rib walls 40 face an upper terminal end of the sleeve 31 in an opposed orientation relative to the lower terminal end of each of the legs 11, whereupon clamping of the sleeve 31 effects enhanced engagement with the associated extension leg 13. Further, each of the friction ribs 31 includes a plurality of suction cavities 37 in communication with the rib top surface 38 through a suction cavity conduit 39. Upon compression of the extension leg 13 within a split sleeve and associated resilient liner 35, expelled air due to compression of the suction cavities 37 positioned below each top surface 38 of each rib 36 effects enhanced suctioning and engagement of the extension leg 13 relative to the liner 35 and associated lock sleeve 31 in use.

Figure 12:
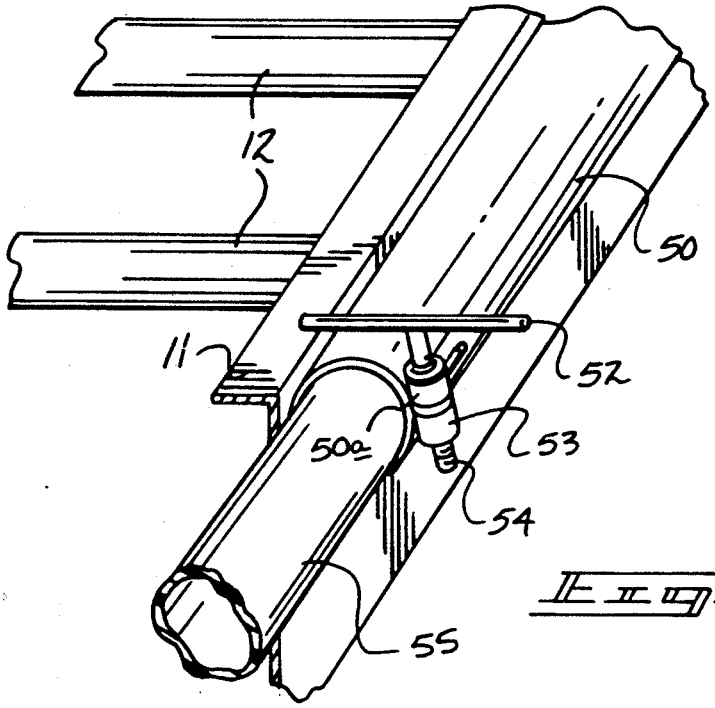
FIG. 12 is an isometric illustration of a further modification of the invention.
Figure 13:
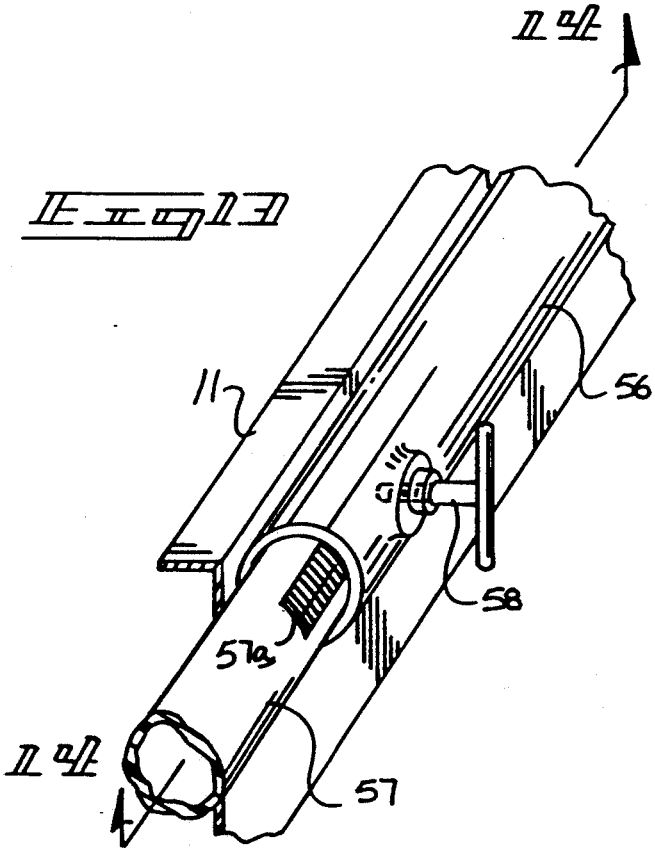
FIG. 13 is an isometric illustration of a yet further modification of the invention.
Figure 14:
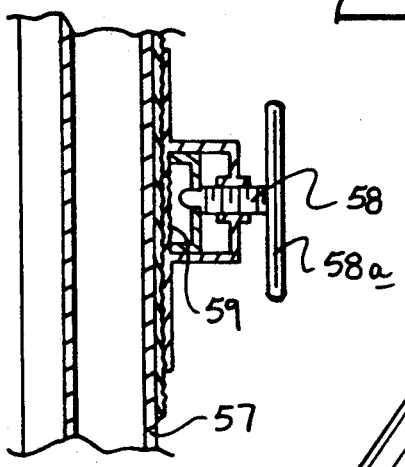
FIG. 14 is an orthographic view, taken along the lines 14—14 of FIG. 13 in the direction indicated by the arrows.
Figure 15:
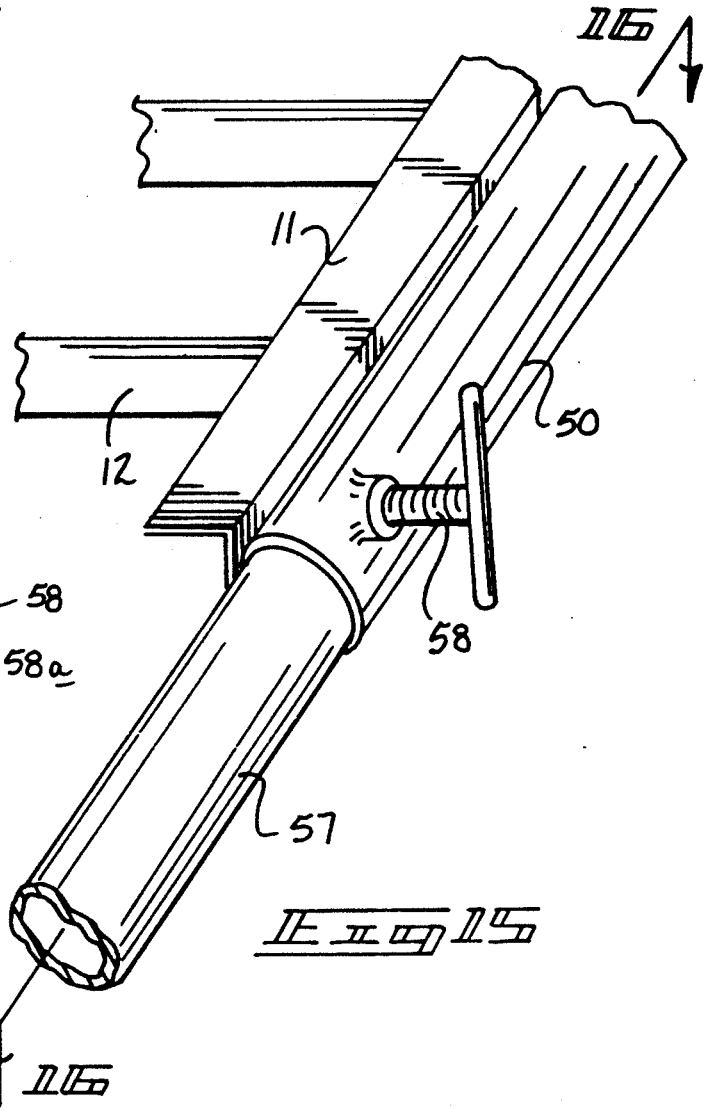
FIG. 15 is an isometric illustration of a modified clamp structure of a yet further modification of the invention of FIG. 13.
Figure 16:
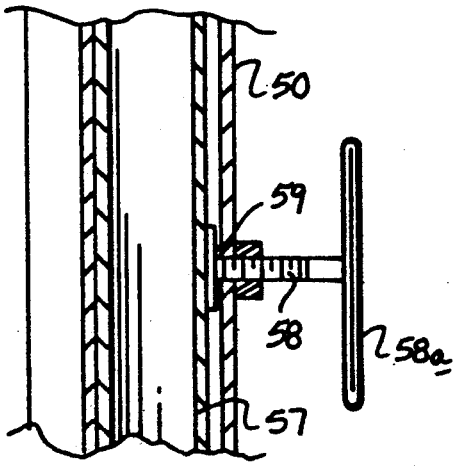
FIG. 16 is an orthographic view, taken along the lines 16—16 of FIG. 15 in the direction indicated by the arrows.

The FIG. 12 illustrates the use of the outer tube 50 mounted relative to the ladder rail 11, wherein an adjusting clamp 53 includes a "T" bar screw 52 orthogonally mounted to an upper terminal end of the screw rod 54, whereupon tensioning of the clamp structure relative to a split forward end 50*a* of the outer tube 50 effects a tightening or loosening of the adjustable leg 55 permitting its relative telescoping to the outer tube 50. The organization of FIG. 13 includes a "T" bar adjusting screw 58 diametrically directed through the outer tube 56 to effect a loosening or tightening as required of the adjustable leg 57, wherein the adjustable leg includes a serrated pattern 57*a* cooperative with a "T" bar screw 58. To this end, reference to FIG. 14 illustrates the serrated clamping foot 59 cooperative with the portion 57*a* to effect the aforenoted clamping relative to the adjustable leg 57. The modification of FIG. 15 may include a frictional clamping foot 59 directed interiorly of the sleeve 50 to provide for selective clamping of the adjustable leg 57, in a manner as discussed relative to the organization as set forth in the FIGS. 13 and 14.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable ladder apparatus, comprising, a ladder including a plurality of spaced ladder legs, the ladder legs are arranged in a coextensive relationship, and the ladder legs include a plurality of spaced ladder rungs directed fixedly between the ladder legs, and each ladder leg including a lower terminal end, and a ladder leg extension adjustably mounted relative to each ladder leg lower terminal end, and wherein each ladder leg includes a tube member mounted to an exterior surface of each ladder leg, and each tube member includes said ladder leg extension telescopingly mounted therewithin, and each ladder leg extension includes a plurality of extension apertures, and each tube member includes a plurality of extension apertures, and each tube member includes diametrieally aligned first apertures directed therethrough, and each ladder leg includes a second aperture aligned with said first apertures, and a lock pin, the lock pin including a tether line mounting the lock pin to each tube member, and each lock pin simultaneously received within the first, second, and extension leg apertures for fixedly mounting each extension leg relative to each tube member, and each extension leg is internally threaded, and including an externally threaded further extension leg, wherein the further extension leg is threadedly received within the internally threaded extension leg, and the further extension leg includes a further extension leg lower terminal end, the further extension leg lower terminal end includes a ball and socket connection, the ball and socket connection of each further extension leg including a support plate to permit pivotment of the further extension leg relative to the support plate, and each ladder leg includes a spring-biased split cylindrical lock sleeve, the lock sleeve including an elongate slot through a cylindrical wall of the lock sleeve defining a first edge and a second edge, the first edge including at least one clamp member to include a clamp loop, and the second edge of the lock sleeve including at least one clamp boss cooperative with the clamp loop to effect selective biasing and securement of the second edge relative to the first edge of the lock sleeve, and the extension leg reciprocatably mounted within the lock sleeve, and each lock sleeve including a resilient liner coextensively secured to an interior surface of the lock sleeve, and the lock sleeve defining a cylindrical interior surface, and the extension leg defining a cylindrical exterior surface.

2. An apparatus as set forth in claim 1 wherein the lock sleeve includes a lock sleeve central axis, and the resilient liner includes a series of equally spaced parallel friction ribs coextensively formed on the liner directed interiorly of the lock sleeve, and the friction ribs are oriented orthogonally relative to the axis.

3. An apparatus as set forth in claim 2 wherein each of the ribs includes a planar rib wall, and each planar rib wall of each friction rib is arranged parallel relative to one another, and each planar rib wall is oriented in confronting relationship to a rear terminal end of each lock sleeve in opposed relationship relative to each reapective lower terminal end of each ladder leg, and each friction rib includes an inclined rib top surface, each inclined rib top surface projects downwardly from an upper terminal end of an upper friction rib downwardly to a lower terminal end of a lower friction rib, and each rib top surface includes a suction cavity conduit projecting into the resilient liner from the rib top surface, and each suction cavity conduit including a suction cavity positioned below each rib top surface and projecting laterally beyond each suction cavity conduit, and each rib top surface includes a plurality of suction cavity conduits and associated suction cavities associated therewith.

* * * * *